US009385447B2

(12) United States Patent
Dold et al.

(10) Patent No.: US 9,385,447 B2
(45) Date of Patent: Jul. 5, 2016

(54) ELECTRICAL CONTACTING OF TENSILE CARRIERS IN SUPPORT COMPONENTS

(71) Applicant: Inventio AG, Hergiswil NW (CH)

(72) Inventors: Florian Dold, Root (CH); Volker Zapf, Obernau (CH)

(73) Assignee: Inventio AG, Hergiswil (CH)

( * ) Notice: Subject to any disclaimer, the term of this patent is extended or adjusted under 35 U.S.C. 154(b) by 586 days.

(21) Appl. No.: 13/714,507

(22) Filed: Dec. 14, 2012

(65) Prior Publication Data

US 2013/0157497 A1 Jun. 20, 2013

(30) Foreign Application Priority Data

Dec. 16, 2011 (EP) ..... 11193958

(51) Int. Cl.

| | |
|---|---|
| ***B66B 5/02*** | (2006.01) |
| ***B66B 7/12*** | (2006.01) |
| ***H01R 4/24*** | (2006.01) |
| ***B66B 3/00*** | (2006.01) |
| ***H01R 12/00*** | (2006.01) |
| ***B66B 5/00*** | (2006.01) |

(52) U.S. Cl.

CPC ..... *H01R 9/0757* (2013.01); *B66B 5/0025* (2013.01); *B66B 5/0031* (2013.01); *B66B 7/1223* (2013.01); *H01R 4/242* (2013.01)

(58) Field of Classification Search

CPC ..... B66B 5/0025; B66B 7/062; B66B 7/085; D07B 1/14; G01N 27/72; G01N 27/20; H01R 4/242; H01R 4/2404

IPC ..... B66B 3/00

See application file for complete search history.

(56) References Cited

U.S. PATENT DOCUMENTS

| | | | | |
|---|---|---|---|---|
| 3,816,818 | A * | 6/1974 | Meier | 439/412 |
| 7,410,033 | B2 * | 8/2008 | Veronesi et al. | 187/391 |
| 7,506,728 | B2 * | 3/2009 | Hawkes et al. | 187/411 |
| 2006/0180402 | A1 * | 8/2006 | Silberhorn et al. | 187/255 |
| 2008/0200077 | A1 | 8/2008 | Faulkner et al. | |
| 2009/0098761 | A1 | 4/2009 | Motohira et al. | |

FOREIGN PATENT DOCUMENTS

| | | | | |
|---|---|---|---|---|
| DE | 2330038 | A1 * | 5/1974 | H01R 4/245 |
| EP | 1530040 | A1 * | 5/2005 | B66B 7/062 |

(Continued)

OTHER PUBLICATIONS

EPO, Machine Translation, WO2010057797 A1, May 18, 2015, pp. 1, 3-4.*

*Primary Examiner* — William A Rivera
*Assistant Examiner* — Stefan Kruer
(74) *Attorney, Agent, or Firm* — Fraser Clemens Martin & Miller LLC; William J. Clemens

(57) ABSTRACT

A system for electrical contacting of tensile carriers in support means includes a support means and a contacting device. The support means has a casing and at least four tensile carriers. The tensile carriers are arranged parallel to one another in the casing and lie substantially in one plane. The contacting device has a contact element. The contact element has a cutting side for penetration of the casing, wherein the cutting side of the contact element is so guided through the casing that the contact element contacts the at least four tensile carriers at least by the cutting side.

14 Claims, 4 Drawing Sheets

(56) References Cited

FOREIGN PATENT DOCUMENTS

| | | | |
|---|---|---|---|
| WO | 2005/094249 | A2 | 10/2005 |
| WO | 2010/057797 | A1 | 5/2010 |
| WO | 2011/003790 | A1 | 1/2011 |
| WO | 2011/098847 | A1 | 8/2011 |

* cited by examiner

ELECTRICAL CONTACTING OF TENSILE CARRIERS IN SUPPORT COMPONENTS

CROSS-REFERENCE TO RELATED APPLICATION

This application claims priority to European Patent Application No. 11193958.3, filed Dec. 16, 2011, which is incorporated herein by reference.

FIELD

The disclosure relates to electrical contacting of tensile carriers in support components.

BACKGROUND

In many conveying devices such as, for example, elevator installations, cranes or hoists use is made of belt-shaped support means. These support means in general comprise several tensile carriers which consist of steel wires and which absorb the tensile forces to be accepted by the support means. The tensile carriers are usually surrounded by a casing of synthetic material. The casing protects the tensile carriers from, for example, mechanical wear, because the support means are frequently guided over deflecting points. In addition, the casing improves the traction of the support means on deflecting or drive rollers and fixes the arrangement of the tensile carriers with respect to one another.

Such support means within a conveying device are often a safety-critical component. Failure or breakage thereof can lead to dropping down of the object to be conveyed. This can lead to significant damage to articles or harm to persons. For this reason, check units are used in conveying devices which check, in particular, the mechanical state of the tensile carriers. Damage to the tensile carriers accepting the forces shall thereby be able to be recognized in good time so that the support means in the case of damage can be exchanged in order to help prevent failure of the conveying device.

The tensile carriers are surrounded by the electrically insulating casing of synthetic material. For performance of a test of the state of the tensile carriers in some methods a contacting of a contact element with the tensile carrier is required. In this known method with the help of the contact element an electric current is conducted through the tensile carriers and serves as a test current establishing the state of the tensile carriers. Apart from that, other test methods which do not operate with electrical current, for example ultrasound, also come into consideration.

SUMMARY

Some embodiments comprise a system for electrical contacting of tensile carriers in support means, in which the tensile carriers can be contacted reliably and in a precise manner by a contact element so as to be able to detect a state of the tensile carriers.

In further embodiments, a system for electrical contacting of tensile carriers in support means comprises a support means and a contacting device. The support means has a casing and at least four tensile carriers, which are arranged parallel to one another in the casing and which lie substantially in one plane. The contacting device has a contact element. The contact element has a cutting side for penetration of the casing, wherein the cutting side of the contact element is guided through the casing in such a manner that the contact element contacts the at least four tensile carriers at least by the cutting side.

This solution can mean that all tensile carriers of a support means can be contacted by only one contact element. Thus, only one contact element has to be led through the casing of the support means. This can simplify the use of this system for electrical contacting of tensile carriers in support means. In addition, through such a system all tensile carriers in the support means can be connected in parallel in simple mode and manner.

The contact element with the cutting side additionally can allow that the contact element can be driven in knife-like manner through the casing in order to contact the tensile carriers.

Such a cutting side can, for example, be constructed as a rectilinear edge or, however, as a serrated edge with contact points or as an edge with contact depressions or contact elevations. Such contact points or contact depressions or contact elevations can allow that the tensile carriers can be respectively reliably contacted by contact point or contact depression or contact elevation. Possibly, a respective contact point or contact depression or contact elevation is provided per tensile carrier. As a result, all tensile carriers of a support means can be reliably contacted by a single contact element.

In a further embodiment the contacting device comprises a first holding element and a second holding element. The support means is in that case substantially arranged between the first and second holding elements. The contact element is supported by one of the two holding elements so that the cutting side of the contact element is directed towards the support means. Such holding elements facilitate guidance of the contact element in desired manner through the casing of the support means.

In a further embodiment the first and second holding elements are connected together by a first fastening element and a second fastening element. Possibly, the first and second holding elements are displaceable relative to one another through actuation of the first and second fastening elements. The holding elements can thus be guided towards one another in order to thereby drive the contact element into the casing of the support means.

In a further embodiment a hinge and a fastening element are provided in order to connect the first and second holding elements with one another. This can mean that only one fastening means has to be actuated in order to displace the first and second holding elements relative to one another and thereby drive the contact element into the casing of the support means.

In another embodiment the first and second fastening elements or the single fastening element is or are constructed as a respective screw with nut. However, other embodiments are also possible.

In another embodiment an electrical voltage is applied to a first contact element, which is arranged at a first support means end, in a use state, in which case an electrical current is measured which flows from the first contact element to a second contact element arranged at a second support means end. Any damage in the tensile carriers can thereby be ascertained.

In a further embodiment the support means comprises at least five tensile carriers, wherein the contact element contacts the at least five tensile carriers.

In a further embodiment an elevator installation with such a system for electrical contacting of tensile carriers in support means is provided. In that case, the contacting devices are possibly arranged at regions of the support means which are not rolled over.

BRIEF DESCRIPTION OF THE DRAWINGS

The description refers to the drawings, in which.

DETAILED DESCRIPTION

Figure 1:
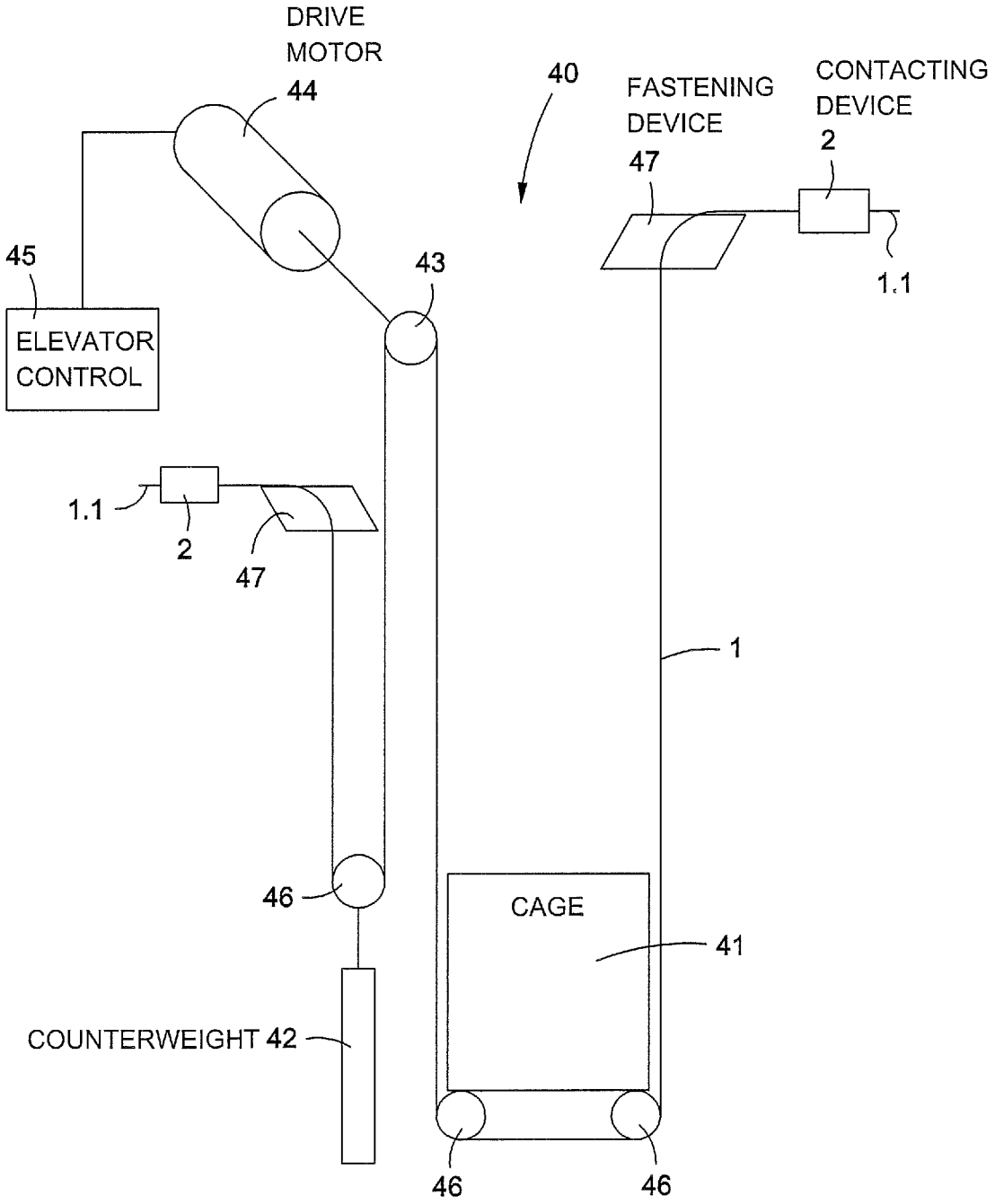
FIG. 1 shows an exemplifying embodiment of an elevator installation with a system for electrical contacting of tensile carriers in support means.

In FIG. 1 two contacting devices 2 for contacting a support means 1 (also called a support component) are installed in an elevator installation 40. The schematic and exemplifying elevator installation 40 includes at least one elevator cage 41, counterweight 42 and support means 1 as well as a drive pulley 43 with associated drive motor 44. The drive pulley 43 drives the support means 1 and thus moves the elevator cage 41 and the counterweight 42 diametrically oppositely. The drive motor 44 is controlled by an elevator control 45. The cage 41 is designed to receive persons and/or goods and to transport them between stories of a building. The cage 41 and counterweight 42 are guided along guides (not illustrated). In the example, the cage 41 and the counterweight 42 are respectively suspended at support rollers 46. The support means 1 is in that case fixed to a first support means fastening device 47 and then initially guided around the support roller 46 of the counterweight 42. The support means 1 is then laid over the drive pulley 43, guided around the support roller 46 of the cage 41 and finally connected with a fixing point by a second support means fastening device 47. This means that the support means 1 runs over the drive 43, 44 at a speed which is higher in correspondence with a suspension factor. In the example, the suspension factor is 2:1.

A free end 1.1 of the support means 1 is provided with the contacting device 2 for temporary or permanent contacting of the support means 1. In the illustrated example a contacting device 2 of that kind is arranged at both ends of the support means 1. In an alternative form of embodiment (not illustrated) only one contacting device 2 is arranged at one of the support means ends 1.1. The support means ends 1.1 are no longer loaded by the tension force in the support means 1, since this tension force is already conducted beforehand into the building by way of the support means fastenings 47.

The contacting devices 2 are thus arranged in a region of the support means which is not rolled over.

The illustrated elevator installation 40 in FIG. 1 is by way of example. Other suspension factors and arrangements are possible. The contacting device 2 for contacting the support means 1 is then arranged in correspondence with the placing of the support means fastenings 47.

Different exemplifying embodiments of support means 1, which can be used in a system for electrical contacting of tensile carriers in support means, are illustrated in FIGS. 2*a* to 2*d*. The support means 1 respectively comprise a casing 5 and at least four tensile carriers 3. The tensile carriers 3 are in that case arranged parallel to one another in the casing 5 and lie substantially in one plane. The number of tensile carriers 3 and the form of the casing 5 can in that case be of different designs.

Figure 2A:
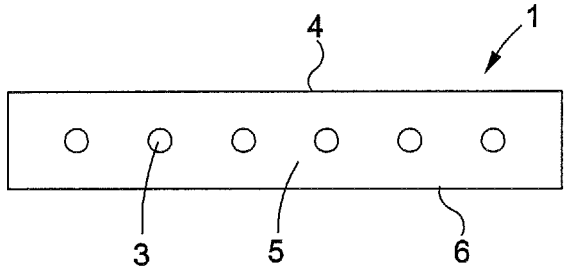
FIGS. 2*a* to 2*d* show exemplifying embodiments of support means for use in a system for electrical contacting of tensile carriers in support means.

FIG. 2*a* shows an exemplifying support means 1 with a rectangular cross-section and six tensile carriers 3 arranged parallel to one another. The support means 1 has a rear side 6 and a traction side 4. In this embodiment the support means 1 is of symmetrical form, i.e. the rear side 6 can be used as traction side or the traction side 4 can be used as rear side.

Figure 2B:
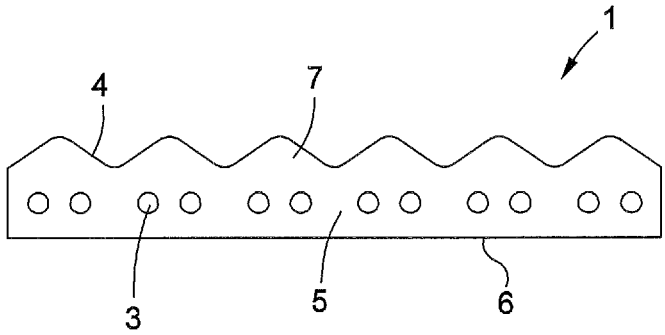

A further exemplifying support means 1 is illustrated in FIG. 2*b*. In this embodiment the traction side 4 has longitudinal ribs 7. Such longitudinal ribs 7 improve the traction behavior of the support means 1 and allow precise lateral guidance of the support means 1 on drive or deflecting rollers. The rear side 6 is constructed as in FIG. 2*a* without additional structures. In this embodiment the support means 1 has six longitudinal ribs 7, wherein two tensile carriers 3 are associated with each longitudinal rib 7. Thus, in total twelve tensile carriers 3 are arranged in the casing 5 of the support means 1.

Figure 2C:
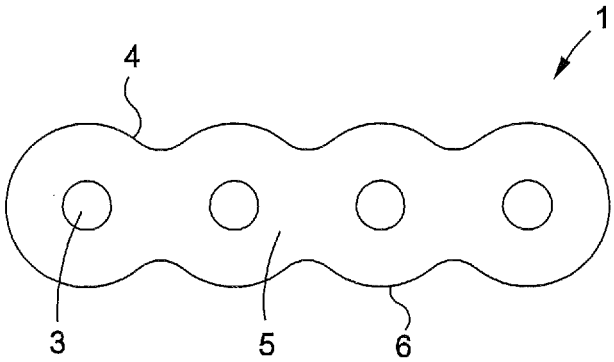

A further exemplifying form of embodiment of a support means 1 is illustrated in FIG. 2*c*. In this embodiment the support means 1 has four tensile carriers 3 in the casing 5. In that case, the casing 5 is contoured around the tensile carries 3 so that the traction side 4 and also the rear side 6 have a wavy form.

Figure 2D:
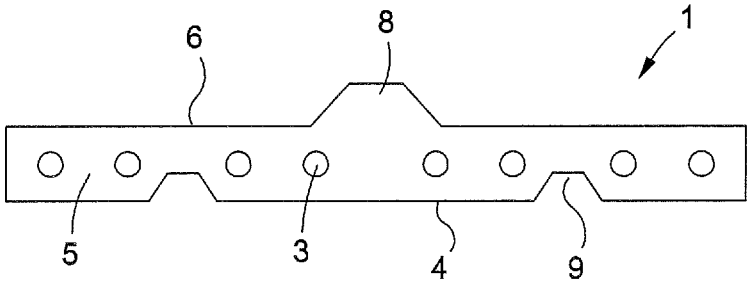

A further exemplifying form of embodiment of a support means 1 is illustrated in FIG. 2*d*. This exemplifying support means 1 comprises eight tensile carriers 3 which are arranged parallel to one another and surrounded by the casing 5. The rear side 6 has a guide rib 8. It is thereby achieved that the support means 1 even when it is guided on its rear side 6 over deflecting rollers, can be guided laterally. In addition, the support means 1 has two guide grooves 9 on its traction side 4. The support means 1 can thus be laterally guided by corresponding guide channels on a drive or deflecting roller.

The support means 1 illustrated in FIGS. 2*a* to 2*d* are exemplifying forms of embodiment of a support means 1 which can be used in a system for electrical contacting of tensile carriers in support means. Any other forms of embodiment of support means can be used in such a system.

Different embodiments of a contact element 10 for use in a system for electrical contacting of tensile carriers in support means are illustrated in FIGS. 3*a* to 3*d*. These contact elements 10 each comprise a contact element body 12 and a cutting side 11. The cutting side 11 is suitable for the purpose of puncturing the casing of a support means and thereby leading the contacting element 10 up to the tensile carriers in the interior of the support means. The contact element body 12 is possibly made of an electrically conductive material such as, for example, a metal. The contact element body 12 is in addition possibly of sufficiently robust construction so that the contact element 10 when guided into the support means casing is not damaged. The cutting side 11 is possibly constructed similar to a crest of a knife blade so as to enable a corresponding cutting action.

Figure 3A:
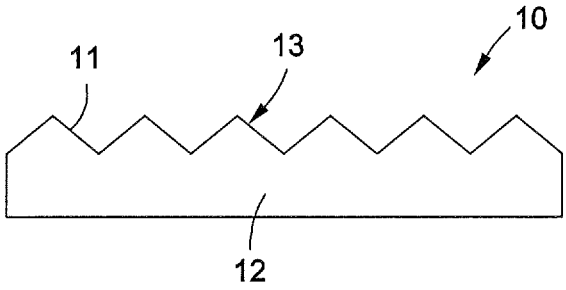
FIGS. 3*a* to 3*d* show exemplifying embodiments of a contact element for use in a system for electrical contacting of tensile carriers in support means.
Figure 3B:
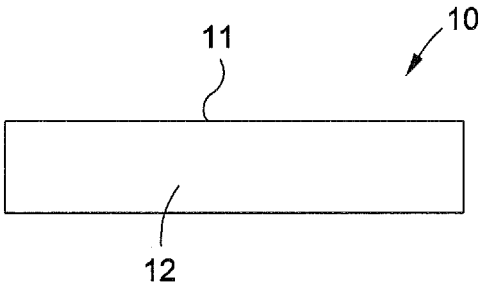
Figure 3C:
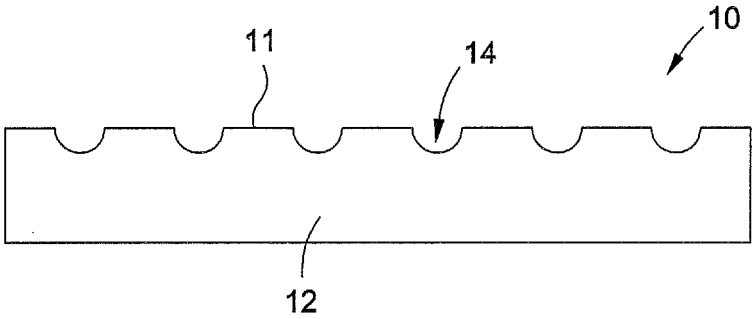
Figure 3D:
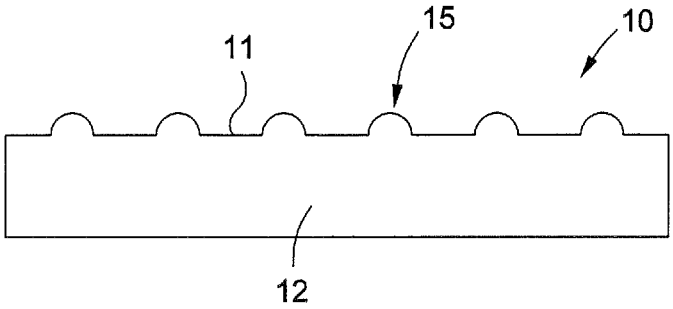

The cutting side 11 of the contact element 10 in FIG. 3*b* is of substantially rectilinear construction. Such a contact element 10 can be used for many different support means, since the cutting side 11 is not matched to a specific number and arrangement of the tensile carriers in the support means. By contrast, the cutting sides 11 in FIGS. 3*a*, 3*c* and 3*d* have an irregular shape. Such irregular shapes are matched to the support means to be used with the contact element 10. Thus, for example, the contact element 10 of FIG. 3*a* is provided for a support means with six tensile carriers. The contact points 13 in that case enable reliable contacting of the individual tensile carriers. In addition, the contact points 13 facilitate guidance of the contact element 10 through the casing of the support means. The contact depressions 14 or contact elevations 15 in FIGS. 3*c* and 3*d* serve a purpose similar to the contact points 13 in FIG. 3*a*. The contact depressions 14 are, in a use state, respectively arranged around a tensile carrier. The tensile carriers are thereby not contacted punctiformly, as is the case with contact points, but the tensile carriers are contacted on a greater part of the circumferential surface thereof by the contact depressions 14 of the contact element 10. The contact elevations 15 have an effect similar to the contact points 13, with the difference that the contact elevations 15 are rounded.

The contact elements 10 in FIGS. 3*a* to 3*d* are again exemplifying forms of embodiment for use in a system for electrical contacting of tensile carriers in support means. Such a contact element 10 can be constructed in various other ways (not illustrated).

Figure 4A:
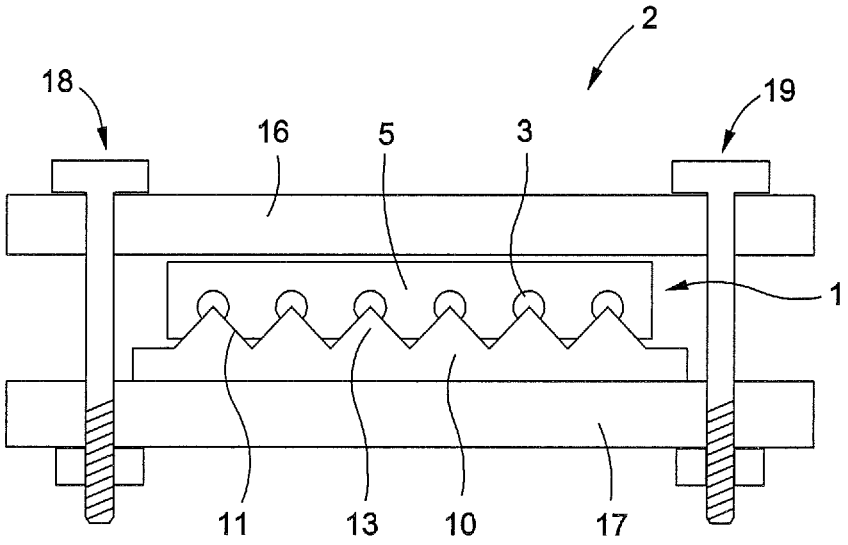
FIGS. 4*a* and 4*b* show exemplifying embodiments of a system for electrical contacting of tensile carriers in support means, with a support means and a contacting device.
Figure 4B:
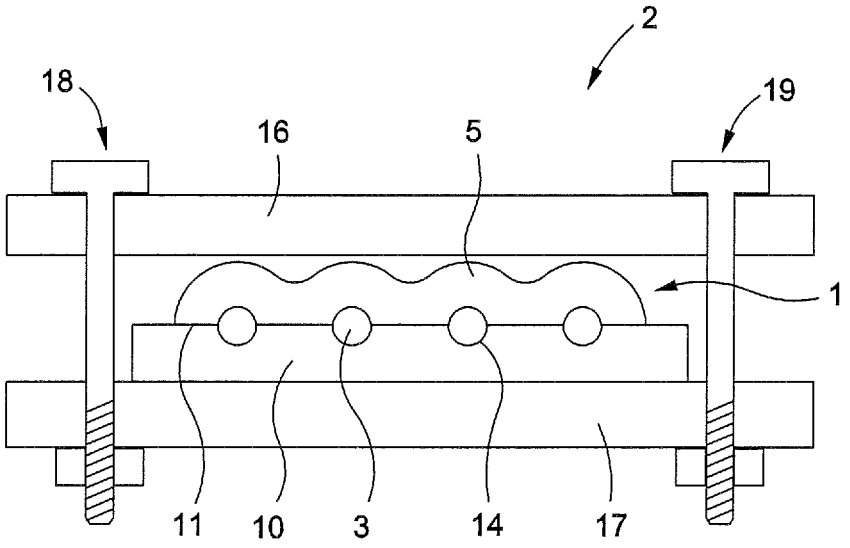

A system for electrical contacting of tensile carriers in support means is illustrated in each of FIGS. 4*a* and 4*b*. In that case, a support means 1 with a rectangular cross-section and six tensile carriers 3 arranged parallel to one another is illustrated in FIG. 4*a*. A support means 1 with a wavy traction side or rear side and four tensile carriers 3 arranged parallel to one another is illustrated in FIG. 4*b*. The contact elements 10 used in the respective system are matched to the respective support means 1. Thus, in FIG. 4*a* a contact element 10 with contact points 13 is arranged, wherein the number of contact points 13 corresponds with the number of tensile carriers 3. Correspondingly, in FIG. 4 a contact element 10 with contact depressions 14 is illustrated. The number of contact depressions 14 again corresponds with the number of tensile carriers 3.

The support means 1 is respectively surrounded by a first holding element 16 and a second holding element 17. In that case, the contact element 10 is respectively supported by the second holding element 17 so that the cutting side 11 of the contact element 10 is oriented towards the support means 1. The first and second holding elements 16 and 17 are connected together by a first fastening element and a second fastening element 19. Through actuation of the fastening elements 18 and 19 the first and second holding elements 16 and 17 are displaceable relative to one another. The contact element 10 is thus guided in the casing 5 of the support means 1 by such an actuation of the fastening elements 18 and 19. The fastening elements 18 and 19 are now actuated until the contact element 10 contacts all tensile carriers 3 of the support means 1. In this embodiment the fastening elements 18 and 19 are respectively constructed as a screw with nut. After contacting of the tensile carriers 3 has taken place by the contact element 10 a voltage is applied so that a test current flows through the tensile carriers 3 in order to ascertain the state of the tensile carriers 3.

In an alternative embodiment (not illustrated) only one fastening element 18, 19 is provided and the second fastening element is replaced by a hinge. The two elements 16 and 17 are thereby already connected together, which simplifies mounting, and only one fastening element 18, 19 has to be actuated in order to arrange the contacting device 2 at the support means 1.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. A system for electrically contacting support component tensile carriers, the system comprising:

a support component, the support component comprising a casing and at least four tensile carriers, the at least four tensile carriers being arranged parallel to each other in the casing and being arranged substantially in a plane; and a contacting device, the contacting device comprising a single electrically conductive contacting element, the contacting element comprising a cutting side, the cutting side configured to penetrate the casing and further configured to simultaneously contact and electrically connect the at least four tensile carriers in parallel.

2. The system of claim 1, the contacting device further comprising a first holding element and a second holding element, the support component being arranged substantially between the first and second holding elements.

3. The system of claim 2, the contacting element being supported at the second holding element so that the cutting side is directed toward the support component.

4. The system of claim 2, further comprising at least one fastening element connecting the first and second holding elements.

5. The system of claim 4, the first and second holding elements being displaceable relative to one another by actuation of the at least one fastening element.

6. The system of claim 5, the at least one fastening element comprising a screw and a nut.

7. The system of claim 1, the cutting side comprising a substantially rectilinear edge.

8. The system of claim 1, the cutting side comprising a serrated edge with at least four contact points, each contact point being for contacting a respective one of the at least four tensile carriers.

9. The system of claim 1, the cutting side comprising at least four contact depressions, each contact depression being for contacting a respective one of the at least four tensile carriers.

10. The system of claim 1, the cutting side comprising at least four contact elevations, each contact elevation being for contacting a respective one of the at least four tensile carriers.

11. The system of claim 1, wherein in a use state an electrical voltage is applied to the contacting element to detect damage to the at least four tensile carriers.

12. The system of claim 1, the support component comprising at least five tensile carriers and the cutting side being for contacting the at least five tensile carriers.

13. An elevator installation, comprising:

a support component, the support component comprising a casing and at least four tensile carriers, the at least four tensile carriers being arranged parallel to each other in the casing and being arranged substantially in a plane; and a contacting device, the contacting device comprising a single electrically conductive contacting element, the contacting element comprising a cutting side, the cutting side configured to penetrate the casing and further configured to simultaneously contact and electrically connect the at least four tensile carriers in parallel.

14. A system for electrically contacting support component tensile carriers, the system comprising:

a support component, the support component comprising a casing and at least four tensile carriers, the at least four tensile carriers being arranged parallel to each other in the casing and being arranged substantially in a plane;

a contacting device, the contacting device comprising a single electrically conductive contacting element, the contacting element comprising a cutting side, the cutting side configured to penetrate the casing and further configured to simultaneously contact and electrically connect the at least four tensile carriers in parallel;

a first holding element and a second holding element, the support component being arranged substantially between the first and second holding elements, the contacting element being supported at the second holding element so that the cutting side is directed toward the support component; and at least one fastening element connecting the first and second holding elements, the first and second holding elements being displaceable relative to one another by actuation of the at least one fastening element.

* * * * *